United States Patent [19]

Norton

[11] 4,338,876

[45] Jul. 13, 1982

[54] APPLICATION OF LIQUIDS TO TEXTILES

[75] Inventor: David E. P. Norton, Macclesfield, England

[73] Assignee: Sir James Farmer Norton & Company Limited, Manchester, England

[21] Appl. No.: 165,437

[22] Filed: Jul. 2, 1980

[30] Foreign Application Priority Data

Jul. 5, 1979 [GB] United Kingdom ..... 7923500

[51] Int. Cl.[3] ..... D06B 1/02

[52] U.S. Cl. ..... 118/259; 68/202; 68/205 R; 118/301; 118/314; 118/316; 118/323; 118/325; 118/326; 239/222; 239/224

[58] Field of Search ..... 68/200, 205 R, 202; 8/149, 151; 118/259, 301, 315, 316, 323, 325, 314, 326; 239/122, 222, 224

[56] References Cited

U.S. PATENT DOCUMENTS

| | | | |
|---|---|---|---|
| 1,022,956 | 4/1912 | Lengerke et al. | 68/205 R X |
| 2,894,485 | 7/1959 | Sedlacsik, Jr. | 118/323 X |
| 3,749,313 | 7/1973 | Weitmann | 118/315 X |

FOREIGN PATENT DOCUMENTS

| | | | |
|---|---|---|---|
| 1439963 | 6/1976 | United Kingdom | 68/205 R |

*Primary Examiner*—Philip R. Coe

*Attorney, Agent, or Firm*—Sughrue, Mion, Zinn, Macpeak & Seas

[57] ABSTRACT

The application of liquid to a moving fabric is effected by delivering same to a rotatable spinning disc which centrifugally impels the liquid against the fabric. This action overcomes surface tension causing the liquid droplets to break up into a fine mist so that a large area of fabric is wetted with an amount of liquid which is substantially less than the fabric weight. Also, the velocity imparted to the liquid droplets in mist forms enhances absorption of the liquid by the fabric.

9 Claims, 7 Drawing Figures

APPLICATION OF LIQUIDS TO TEXTILES

BACKGROUND OF THE INVENTION

This invention relates to a method of and apparatus for applying liquid to textile fabrics.

In textile finishing and allied processes it is recognised that it is desirable to limit as much as possible the amount of liquid put into the fabric, say, for example, when impregnating the fabric with finishing agents such as synthetic resins with a view to reducing drying costs and conserving energy.

Many attempts have been made to reduce the quantity of liquid applied but one of the difficulties encountered is in distributing small quantities uniformly across the width of fabric. The droplet size is critical because the portion of the fabric coming into contact with the droplet absorbs all the liquid in the droplet, the adjacent areas of the fabric receiving no liquid at all. This is because fabric will absorb, in most cases, up to its own weight in liquid whereas the desired amount of liquid to be applied is usually 30% or less of the fabric weight.

One method of achieving the desired liquid intake limitation is to overcome the surface tension of the liquid thereby reducing the droplet size and obtaining a wider and more uniform distribution of liquid across the width of the fabric.

SUMMARY OF THE INVENTION

The present invention provides such a method and an apparatus for carrying out the same.

According to the present invention there is provided a method of applying liquid to a textile fabric comprising the step of centrifugally impelling the liquid in the form of a fine mist-like spray against a moving fabric uniformly to distribute the liquid across the width of the fabric.

More specifically, the method comprises the step of centrifugally applying the liquid to the fabric by feeding the liquid onto a rotatable spinning disc adjacent the fabric.

Preferably the method comprises the step of centrifugally applying liquid to both sides of the fabric by arranging at each side of the fabric at least one rotatable spinning disc to which the liquid to be applied is fed.

Preferably the method comprises the step of containing the spray pattern issuing from a spinning disc thereby avoiding excessive overlap between the spray patterns of adjacent spinning discs.

Preferably the method comprises the step of arranging the application of liquid from adjacent spinning discs onto the fabric at different levels for the purposes of avoiding collision between the spray patterns of these spinning discs.

Preferably, the method comprises the step of rotating each spinning disc about an axis parallel or substantially parallel with the direction of travel of the fabric to be wetted.

The method may comprise the step of centrifugally applying liquid from the spinning disc on to the surface of a transfer roller in contact with the fabric surface thereby to improve penetration of the liquid.

Also according to the present invention there is provided an apparatus for applying liquid to a moving fabric, the apparatus comprising at least one rotatable spinning disc past which the fabric can be moved, and liquid supply means for delivering liquid onto a surface of the disc whereby the disc centrifugally impells the liquid in the form of a fine mist-like spray uniformly to distribute the liquid across the fabric width.

Preferably there is at least one rotatable spinning disc with its liquid supply means at each side of the fabric.

Preferably there are a plurality of adjacent side-by-side rotatable spinning discs, there being between adjacent spinning discs a baffle arranged to contain the spray pattern issuing from these discs so that there is no excessive overlap between these spray patterns.

Preferably, adjacent spinning discs are staggered vertically thereby to avoid collision between adjacent spray patterns.

Preferably each spinning disc is disposed within a treatment chamber through which the fabric is constrained to move.

The surface of each spinning disc onto which the liquid is fed may be roughened or otherwise rendered non-smooth to assist in breaking up of the droplets and reducing their size.

Preferably, each spinning disc is rotatable about an axis parallel or substantially parallel to the direction of travel of the fabric.

In a modification of the present invention, a liquid transfer roller is adapted to contact the fabric surface to apply the liquid received thereon from the spinning disc. Such an arrangement is considered to give better liquid penetration.

DESCRIPTION OF THE PREFERRED EMBODIMENTS

Figure 1:
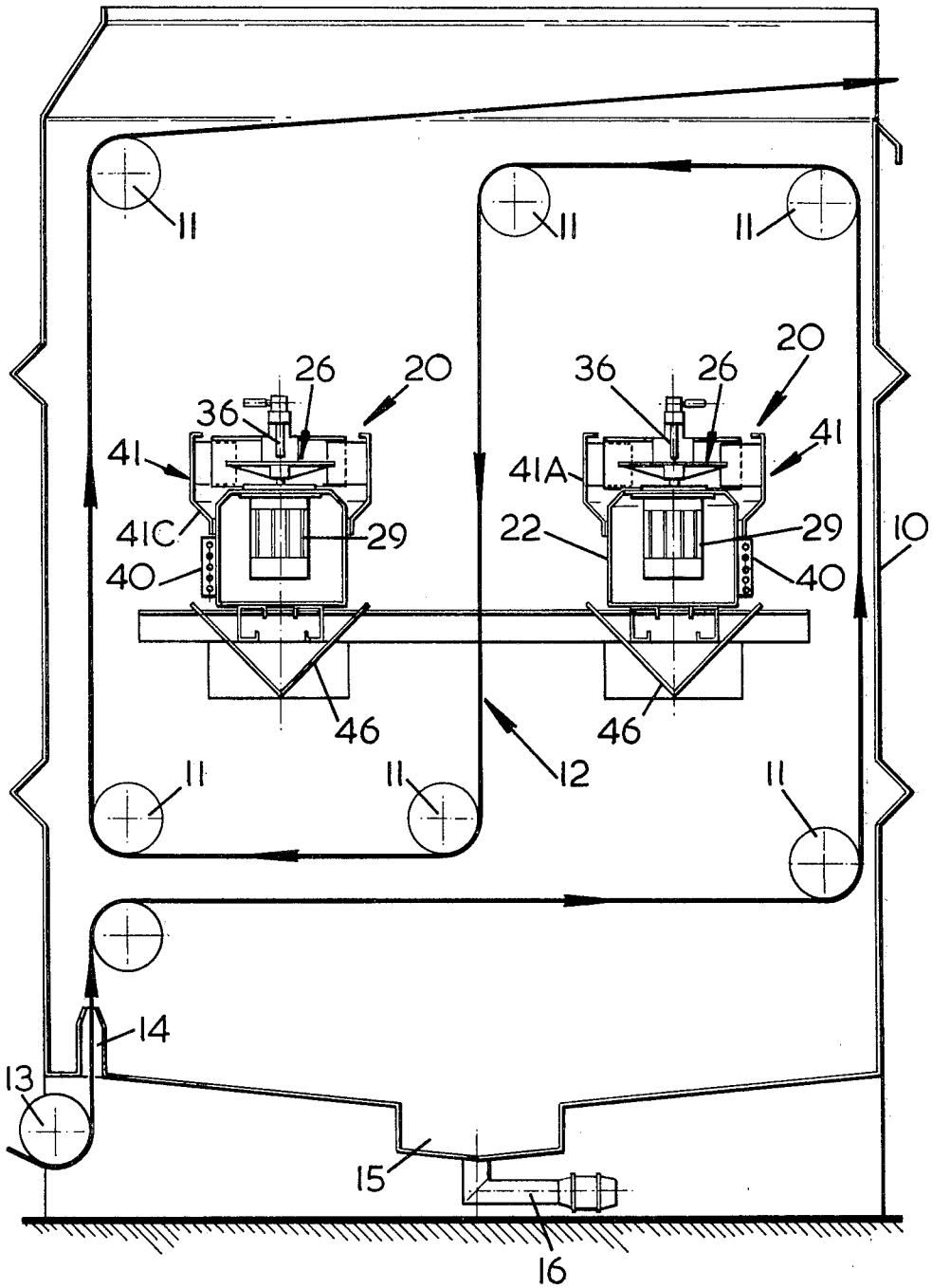
FIG. 1 is a diagrammatic end elevation view of an apparatus for applying liquid to a fabric in accordance with the present invention.
Figure 2:
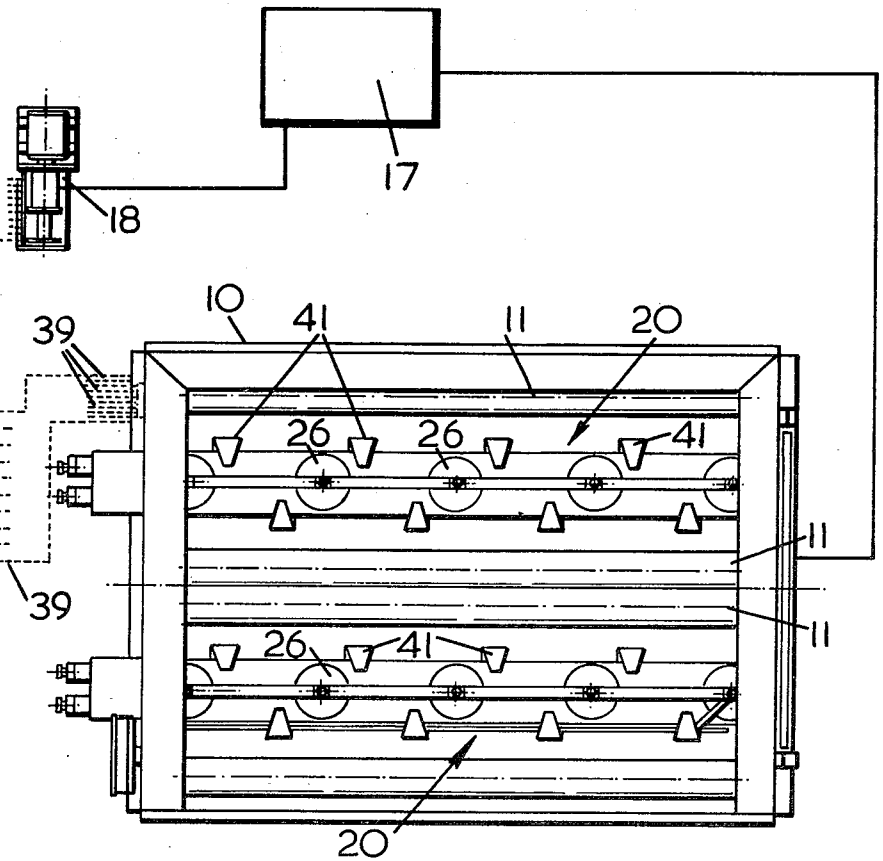
FIG. 2 is a corresponding diagrammatic plan view.

The apparatus comprises an open-topped treatment chamber 10 having an end access door (not shown). Extending across the width of the chamber 10 are a number of freely-rotatable guide rollers 11 defining a fabric path 12 which can be seen from FIG. 1 of the drawings. There is a guide roller 13 at the front of and external to the chamber 10, the fabric passing from this external guide roller 13 to the first of the internal guide rollers 11 through a seal 14 in the bottom of the chamber 10. The bottom of the chamber 10 slopes downwardly to a central sump 15 from which extends one or more drain pipes 16 (only one shown) along which liquid gathered in the sump 15 is pumped back to supply 17 by a proportioning pump 18 with which is associated primary and secondary air accumulators 19A and 19B which serve to smooth out the pulsing delivery of the pump 18. Liquid from the sump 15 may be simply passed to a drain provision in which case should be made to keep the supply topped up.

It is to be noted that the pump 18 is driven by the apparatus serving to pull the fabric through the chamber 10, which apparatus (not shown) may be, for example, a drying apparatus, a mangling nip or a batching apparatus downstream of the chamber 10 in the direction of fabric movement. By this means, the rate of feed of liquid to the fabric is controlled by fabric speed through the chamber 10, that is the faster the fabric travels the higher the delivery rate of the pump 18 and vice versa.

The application of liquid to the fabric is effected by means of two banks 20 of spinning discs so arranged that the fabric passes therebetween so that both sides of the fabric are wetted at the same time (see FIG. 1).

It will be manifest from FIG. 1 that one side of the fabric is also wetted as the fabric moves up the first vertical leg of its travel path while the other side is wetted as the fabric moves up the final vertical leg of its travel path. Thus, each side of the fabric is subject to two applications of liquid.

As the banks 20 of spinning discs are identical only one will be described for the sake of convenience.

The spinning disc assemblies 21 are disposed in a common housing 22 extending across the chamber 10 and supported by structural members 23 extending across the chamber 10, which members 23 are, in turn, supported on beams 24 extending along the side walls 25 of the chamber 10.

Figure 5:
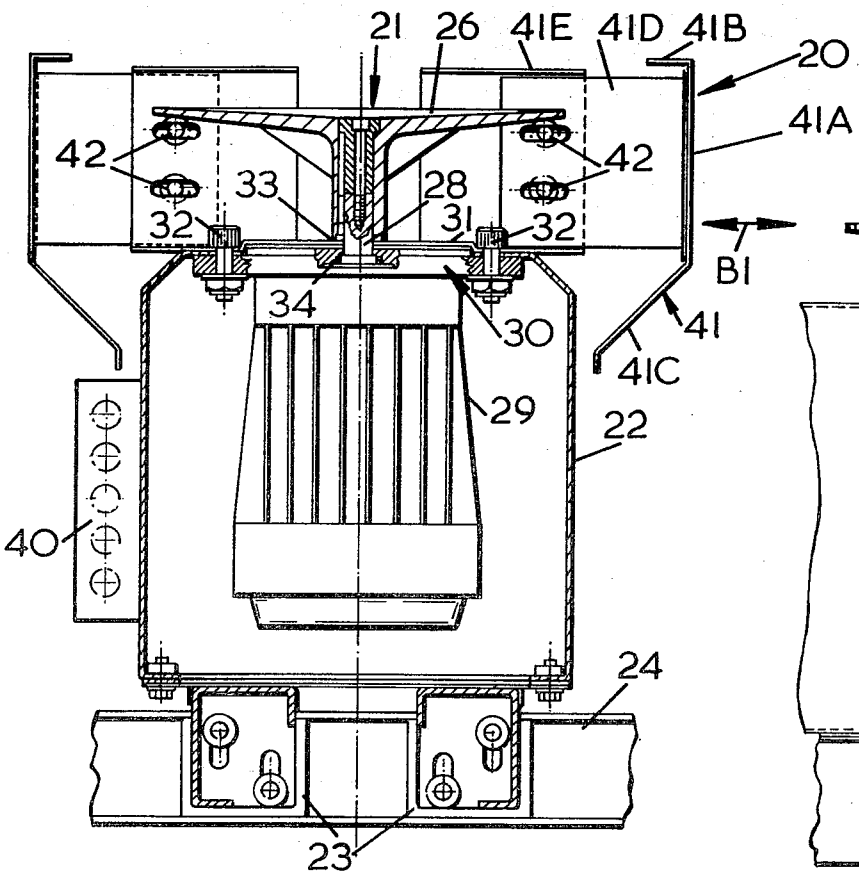

Each spinning disc assembly 21 comprises a spinning disc 26 secured as indicated at 27 (FIG. 5) to the shaft 28 of an electric motor 29 disposed below the disc 26. Thus each disc 26 is independently driven although the motors 29 are centrally controlled to ensure uniform speed of rotation of the discs 26.

The casing 22 has an excess opening 30 for each motor 29 which is closed by a cover plate 31 bolted in position as indicated at 32. Seal rings are fitted round the motor shaft 28 are indicated at 33 and 34 respectively inside and outside the cover plate 31 to render the interior of the housing 22 liquid tight.

It should be noted that adjacent discs 26 are staggered vertically to ensure that the spray patterns of immediately adjacent discs 26 do not collide thus providing a uniform liquid application across the width of the fabric. Consequent upon this vertical staggering, the apparatus has two levels of liquid application.

Figure 3:
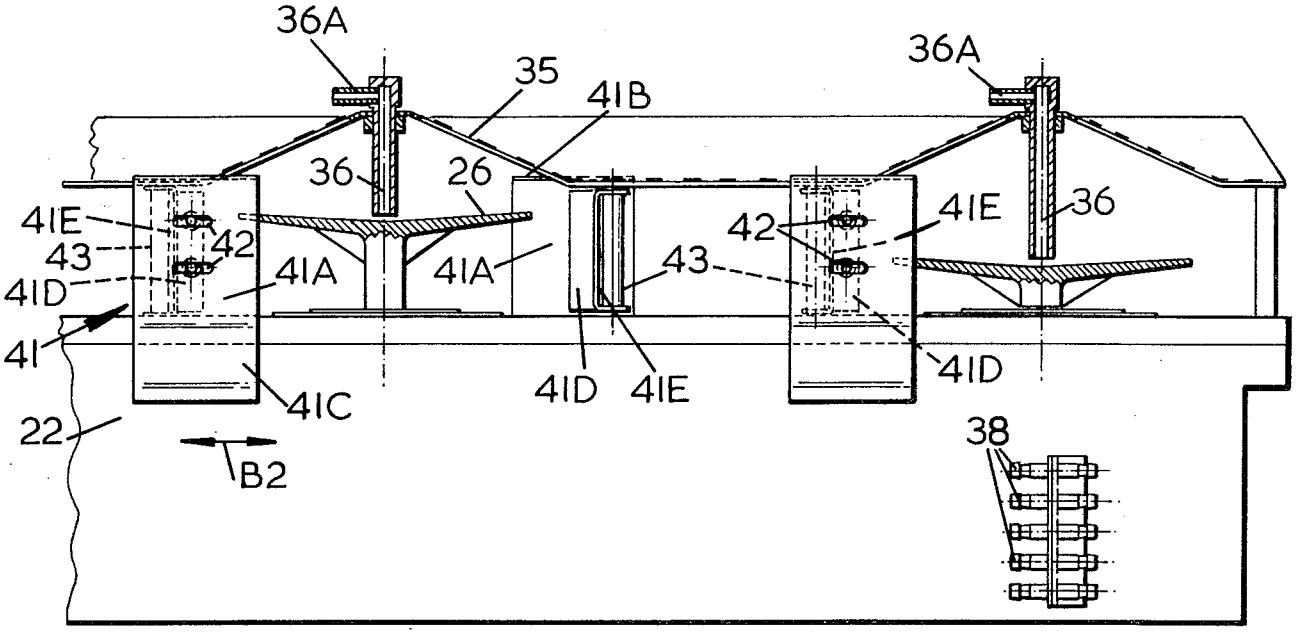
FIGS. 3 and 4 are fragmentary front and plan views of a pair of adjacent spinning discs.
Figure 4:
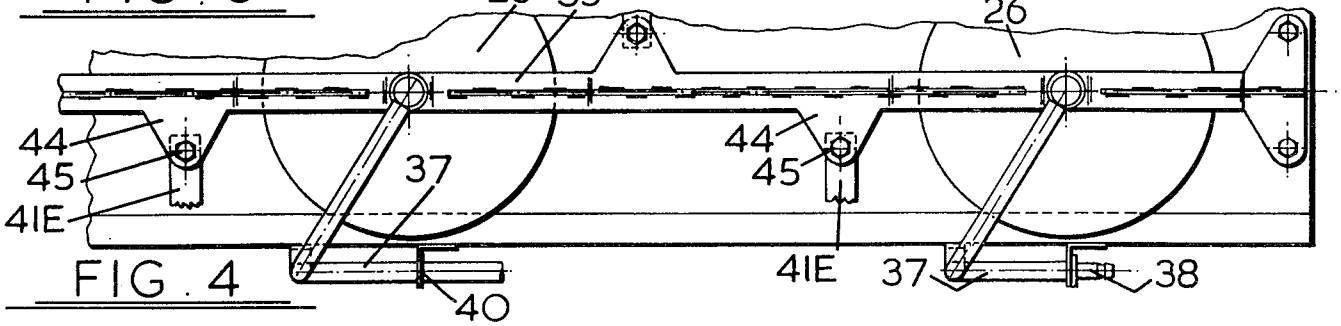
Figure 6:
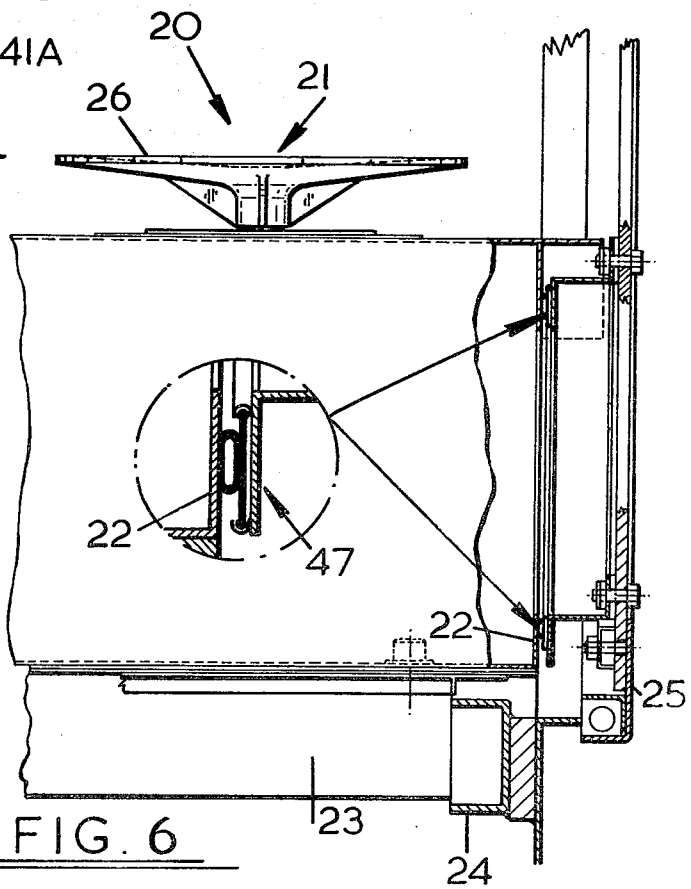
FIGS. 5 and 6 are a transverse sectional view and a front view of two adjacent spinning discs.

Extending across the width of the chamber 10 centrally above the discs 26 is a supporting strap 35 which above each disc 26 has an inverted-V configuration (see FIG. 3). A jet or spray pipe 36 is supported by the strap 35 at the apex of the V directly above the center of the disc 26 to deliver liquid at a controlled rate down onto the disc 26. The pipe 36 has an inlet stem 36A connected by a flexible pipe 37 to one of a number of adapters 38 to the other end of which is connected a flexible pipe 39 leading back to the liquid supply 17 via the accumulators 19A, 19B and the pump 18.

Guides 40 are provided on the casing 22 to retain the flexible pipes 39 close to the wall of the casing 22 thus avoiding any contact between the pipes 39 and the fabric.

A baffle 41 is provided between adjacent discs 26. Each baffle 41 comprises a vertical plate 41A outboard of the spinning disc assemblies 21 with an integral top overhand 41B for impeding upward splashing and an integral bottom inwardly-inclined portion 41C for directing liquid impinging on the baffle 41 downwardly and inwardly. The plate 41A to 41C is adjustably secured, by slot and bolt connection 42 for example, to a right-angled plate 41D extending in towards the spinning disc assemblies 21, which plate 41D is, in turn, connected, again by slot and bolt connection 42 for example, to a plate 41E inturned at top and bottom. A short support pillar 43 is accommodated between these inturns and a lug 44 of the supporting strap 35 is bolted as indicated at 45 through the pillar 43 to the casing 22. The disposition of the baffles 41 relative to the spinning discs 26 is shown in FIG. 1 of the drawings.

Thus, it can be seen that the baffle 41 can be moved in and out relative to its spinning disc 26 as indicated by the arrow B1 and adjusted laterally of the spinning disc 26 as indicated by the arrow B2.

These baffles 41 control the degree of overlap between adjacent spray patterns such that there is no excessive overlap between adjacent spray patterns whereby uniform wetting of the fabric is achieved.

As can be seen from FIG. 1, a trough 46 is disposed under each bank 20 of spinning disc assemblies 21 and is inclined towards one of the chamber side walls so that liquid collected therein, say for example from the baffles 41, is directed to the side wall and from there passes down into the central sump 15.

To ensure that liquid does not leak into the open ends of the common housing 22 at the chamber side walls there is provided a seal arrangement 47 surrounding these open ends.

In use, the fabric to be wet treated, for example the application of resins or other finishing agents, is pulled through the chamber 10 while liquid carrying the resins or finishing agents is pumped to the jet pipes 36 and from there down onto the spinning discs 26 (which for example are being rotated at speeds between 2000 and 3000 r.p.m.). The discs 26 centrifugally throw the liquid outwardly against the fabric with a force sufficient to break up the droplet size into a fine mist-like spray.

As a result of this action of forcibly throwing the liquid against the travelling fabric by a centrifugal action a surface tension is overcome and the liquid droplets break up into a fine mist to cover as large an area of the fabric as is possible. Also, the velocity imparted to the liquid droplets in mist form assists in absorption of the liquid by the fabric. As a result the amount of liquid requiring to be applied is substantially reduced. Tests have shown that the use of as little as 20 to 30% of the fabric weight are is possible.

Uniformity of liquid application is achieved primarily by the provision of the baffles 41 and secondly by the vertical staggering of adjacent spinning discs.

It will be manifest that if it is only desired to wet one side of the fabric then only the appropriate bank 20 should be used. Indeed, the apparatus may, if desired, be provided only with one bank 20 of spinning disc assemblies 21.

Again it will be manifest that depending on the width of the fabric all or only some of the spinning discs of each bank 20 need be used.

Figure 7:
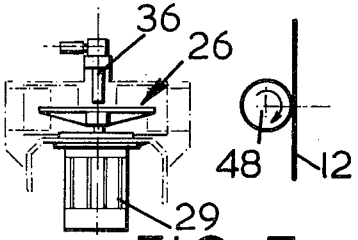
FIG. 7 is a diagrammatic view of a modification of the present invention.

In a modification (FIG. 7), each spinning disc 26 applies liquid to the surface of a transfer roller 48 in contact with the fabric surface thereby to improve penetration of the liquid.

What is claimed is:

1. An apparatus for applying liquid to a moving fabric, comprising:

a fabric treatment chamber;

roller means within the treatment chamber for guiding the fabric passing through the chamber so that the fabric follows at least one vertical path;

a plurality of adjacent side-by-side liquid delivery spinning discs rotatable about vertical axes, the discs being arranged across a width of the fabric adjacent the at least one vertical path;

a delivery pipe mounted directly above a center of each spinning disc for supplying liquid to each disc, the spinning discs centrifugally impelling the liquid in the form of a fine mist-like spray uniformly across the fabric width with each spinning disc forming a pattern on the fabric;

a baffle located at each side of each spinning disc and being between adjacent spinning discs to control a degree of overlap between the spray patterns created by adjacent spinning discs, the baffles of each spinning disc being diametrically opposed and longitudinally displaced relative to one another in the direction of the fabric width; and means for adjustably mounting each baffle relative to its spinning disc to permit the baffle to be adjusted so that each baffle can be moved closer to or further away from its disc and can also be moved lateral to its disc in the widthwise direction of the fabric to permit variation of spray pattern overlap control.

2. The apparatus claimed in claim 1 wherein each baffle has a top overhand to impede upward splashing of liquid impinging onto the baffle.

3. The apparatus claimed in claim 1 wherein each baffle has a lower portion inclined inward towards its spinning disc to direct excess liquid downwardly and inwardly away from the fabric.

4. The apparatus claimed in claim 1 wherein adjacent spinning discs are staggered vertically to avoid collision between adjacent spray patterns.

5. The apparatus claimed in claim 1 further comprising a transfer roller for each spinning disc, the transfer roller being disposed so as to be in contact with the fabric for applying the liquid received thereon to the fabric.

6. The apparatus claimed in claim 1 further comprising a separate driving motor for each spinning disc, the spinning discs being supported in a common housing containing the separate driving motors.

7. The apparatus claimed in claim 1 or 6 further comprising a support member disposed above and extending centrally across the spinning discs, the support member supporting the delivery pipe for each spinning disc and also each baffle mounting means.

8. The apparatus claimed in claim 7, wherein the means for adjustably mounting each baffle comprises first and second bolt and slot connections, a right-angled plate and a second plate, each baffle being connected by the first bolt and slot connection to the right-angled plate which extends in towards its spinning disc, the right-angled plate being connected by the second bolt and slot connection to the second plate which is connected between the support member above the spinning discs and the common housing.

9. The apparatus claimed in claim 6 further comprising a trough below the common housing to collect liquid from the baffles.

* * * * *